United States Patent [19]

Masaki

[11] Patent Number: 5,022,304

[45] Date of Patent: Jun. 11, 1991

[54] MUSICAL TONE SIGNAL GENERATING APPARATUS

[75] Inventor: Kazuo Masaki, Hamamatsu, Japan

[73] Assignee: Yamaha Corporation, Hamamatsu, Japan

[21] Appl. No.: 341,122

[22] Filed: Apr. 20, 1989

[30] Foreign Application Priority Data

Apr. 21, 1988 [JP] Japan ..... 63-98925

[51] Int. Cl.[5] ..... G10H 7/00

[52] U.S. Cl. ..... 84/607

[58] Field of Search ..... 84/604, 605, 606, 607, 84/622, 625

[56] References Cited

U.S. PATENT DOCUMENTS

| | | | |
|---|---|---|---|
| 4,350,072 | 9/1982 | Deutsch | 84/605 |
| 4,353,279 | 10/1982 | Deutsch | 84/605 |
| 4,442,745 | 4/1984 | Gross et al. | 84/607 |
| 4,520,708 | 4/1985 | Wachi | 84/607 |
| 4,524,666 | 6/1985 | Kato | 84/605 |
| 4,674,382 | 6/1987 | Yorihasa | 84/626 |
| 4,713,997 | 12/1987 | Deutsch | 84/605 |
| 4,716,805 | 1/1988 | Deutsch | 84/604 |
| 4,785,707 | 11/1988 | Suzuki | 84/605 |
| 4,916,996 | 4/1990 | Suzuki et al. | 84/607 |

*Primary Examiner*—Geoffrey S. Evans

*Attorney, Agent, or Firm*—Spensley Horn Jubas & Lubitz

[57] ABSTRACT

A musical tone signal generating apparatus is provided for an keyboard electronic musical instrument. This apparatus provides a waveform memory capable of storing musical tone waveform data concerning plural musical tone waveforms each having a different cycle such as a different tone color. The musical tone waveform data can include plural sampling data concerning the musical tone waveform which is picked up by a microphone, for example. Each musical tone waveform is divided into several segments each designated by front (or head) and end addresses. By shifting designation timings of addresses between the front and end addresses of the predetermined segment, two series of musical tone waveform data can be obtained based on the musical tone waveform of the same predetermined segment from the waveform memory. By mixing two series of musical tone waveform data together by a desirable mixing rate, a smooth musical tone waveform corresponding to well-mixed musical tone waveform data can be obtained even when the musical tone waveform of the predetermined segment is repeatedly read out. Then, the apparatus generates a musical tone signal indicative of such smooth musical tone waveform, whereby it is possible to eliminate unnatural portions to be heard in the repeatedly generated musical tone.

13 Claims, 6 Drawing Sheets

MUSICAL TONE SIGNAL GENERATING APPARATUS

BACKGROUND OF THE INVENTION

1. Field of the Invention

The present invention relates to a musical tone signal generating apparatus, and more particularly to a musical tone signal generating apparatus which generates a musical tone signal corresponding to musical tone waveform data pre-stored in a memory, wherein the musical tone waveform data indicates a musical tone waveform including plural waveforms each having a different cycle.

2. Prior Art

Conventionally, the well-known musical tone signal generating apparatus provides a memory for pre-storing the musical tone waveform data whose read-out operation is controlled by address designation. This apparatus repeatedly reads out the musical tone waveform data in the segment designated by a front address and an end address from such memory to thereby generate the musical tone signal corresponding to the read musical tone waveform data. However, in the case where this conventional apparatus repeatedly reads out the musical tone waveform data within the predetermined segment from the continuous musical tone waveform data indicative of the musical tone waveform which is originally picked up from an external musical instrument, the tone color is not varied smoothly at a time when the conventional apparatus begins to read out the musical tone waveform data at the front portion of segment after reading out the musical tone waveform data at the end portion of segment. For this reason, there must be an unnatural portion to be heard in the generated musical tone.

Therefore, recently, the following musical tone generating apparatus is developed. This apparatus, as disclosed in Japanese Patent Laid-Open Publication No. 59-188697 (i.e., U.S. Pat. No. 4,520,708), makes new musical tone waveform data mainly based on the musical tone waveform data indicative of the original musical tone waveform within the repeatedly reading segment and by use of the weighted addition, whereby this new musical tone waveform data is stored in the memory. More specifically, the musical tone waveform data at the front portion of certain segment is added to musical tone waveform data at the end portion of certain segment as weighted-addition data. Thus, at the time when the apparatus begins to read out the musical tone waveform data at the front portion of segment after reading out the musical tone waveform data at the end portion of segment, there is no unnatural portion to be heard in the generated musical tone. Accordingly, it is possible to obtain the musical tone signal whose tone color is smoothly varied, for example.

However, in the above known apparatus, it is necessary to process the original tone waveform picked up externally before storing the musical tone waveform data in the memory. Therefore, this apparatus is disadvantageous in that such processing is troublesome and the special device for such processing must be required. Especially, it is difficult to process this musical tone waveform data within the musical instrument. Therefore, it is impossible to apply the foregoing musical tone generating apparatus as published in Japan to the musical instrument which picks up the desirable external tone before the performance and immediately thereafter uses the musical tone waveform data concerning such picked-up external tone for the performance. In such case, it is impossible to obtain the musical tone signal whose tone color is varied smoothly so that there will not be unnatural portion to be heard in the generated musical tone, for example.

In addition, the foregoing published apparatus processes the musical tone waveform data at the end portion of segment by use of the musical tone waveform data at the front portion of segment. For this reason, the data at the front and end portions of segment must be fixed. Hence, this apparatus can repeatedly read out the same musical tone waveform data only. Due to such reading process, the tone color of the generated musical tone must be fixed. Accordingly, there is another problem in that it is impossible to obtain the musical tone having the complicated and variable tone colors.

SUMMARY OF THE INVENTION

Accordingly, it is a primary object of the present invention to provide a musical tone signal generating apparatus which repeatedly reads out the musical tone waveform data of the predetermined segment, wherein the unnatural portion to be heard in the generated musical tone can be eliminated when repeatedly reading out the musical tone waveform data without processing the original musical tone waveform data to be externally picked up in advance.

In a first aspect of the present invention, there is provided a musical tone signal generating apparatus comprising:

(a) memory means for storing musical tone waveform data indicative of plural musical tone waveforms each having a different cycle, the musical tone waveform being divided into several segments each designated by a front address and an end address, wherein a reading operation of the memory means is controlled by designating addresses;

(b) first reading means for repeatedly reading out the musical tone waveform data of a predetermined segment from the memory means by repeatedly designating addresses between the front and end addresses corresponding to the predetermined segment, so that the musical tone waveform data read by the first reading means is outputted as first musical tone waveform data;

(c) second reading means for repeatedly reading out the musical tone waveform data of the predetermined segment by shifting designation timings of the addresses between the front and end addresses corresponding to the predetermined segment with a predetermined shifting time, so that the musical tone waveform data read by the second reading means is outputted as second musical tone waveform data; and (d) mixing means for mixing the first musical tone waveform data and the second musical tone waveform data together by a mixing rate, whereby a musical tone signal is generated in response to mixed musical tone waveform data outputted from the mixing means.

In a second aspect of the present invention, there is provided a musical tone signal generating apparatus comprising:

(a) a waveform memory for storing musical tone waveform data indicative of plural musical tone waveforms each having a different cycle, the musical tone waveform being divided into several segments each designated by a front address and an end address, wherein a reading operation of the waveform memory is controlled by designating addresses;

(b) detecting means for detecting operations of manual performance controls provided at an electronic musical instrument;

(c) address designating means for designating two series of addresses based on a time sharing system, by which two series of musical tone waveform data are read from the waveform memory;

(d) mixing rate control means for controlling a mixing rate by which the two series of musical tone waveform data are mixed together; and (e) means for mixing the two series of musical tone waveform data by the mixing rate, whereby a musical tone signal is generated in response to mixed musical tone waveform data.

In a third aspect of the present invention, there is provided a musical tone signal generating apparatus comprising:

(a) a waveform memory for storing musical tone waveform data indicative of plural musical tone waveforms each having a different cycle, the musical tone waveform being divided into several segments each having two edges which are respectively designated by a head address and an end address, wherein a reading operation of the waveform memory is controlled by designating the head and end addresses;

(b) detecting means for detecting operations of manual performance controls provided at an electronic musical instrument;

(c) address designating means capable of designating desirable two pairs of head and end addresses based on a time sharing system, by which two series of musical tone waveform data both concerning the same segment of the musical tone waveform are read from the waveform memory, wherein a predetermined phase difference is set between the desirable two pairs of head and end addresses;

(d) mixing rate control means for controlling a mixing rate in accordance with the desirable two pairs of head and end addresses; and (e) means for mixing the two series of musical tone waveform data by the mixing rate, whereby a musical tone signal is generated in response to mixed musical tone waveform data.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

[A] BASIC OPERATION OF THE PRESENT INVENTION

The musical tone signal generating apparatus according to the present invention comprises:

a waveform memory for storing musical tone waveform data;

first reading means for repeatedly reading the musical tone waveform data from the waveform memory as first musical tone waveform data by repeatedly designating the addresses between the front address and end address both designating the predetermined segment;

second reading means for repeatedly reading the musical tone waveform data from the waveform memory as second musical tone waveform data by shifting the designation timings of the addresses between the front and end addresses with the predetermined delay time; and mixing means for mixing the first musical tone waveform data and the second musical tone waveform data together.

In the above-mentioned configuration, the designation timings of addresses of the first reading means are delayed from those of the second reading means by the predetermined delay time. Therefore, the phase of first musical tone waveform data is different from that of second musical tone waveform data. Hence, when the first reading means starts to read out the musical tone waveform data at the front portion of segment as the first musical tone waveform data after reading out the musical tone waveform data at the end portion of segment, the second reading means is now reading the musical tone waveform data at the middle portion of segment a the second musical tone waveform data. At this time, these first and second musical tone waveform data are mixed together, and then the mixed musical tone waveform data is outputted. In this case, the first musical tone waveform data indicates a discontinuous envelope, while the second musical tone waveform data indicates a continuous envelope. For this reason, such discontinuity of first musical tone waveform data is smoothed by the continuous second musical tone waveform data. Thus, the tone color of generated musical tone can be varied smoothly, so that it is possible to obtain the musical tone signal without the unnatural portion to be heard in the generated musical tone.

In addition, the mixing rate of first and second musical tone waveform data can be controlled such that the mixing rate will be gradually increased at the front portion of segment but the mixing rate will be gradually decreased at the end portion of segment. In this case, when the musical tone waveform data at the end portion of segment is varied to that at the front portion of segment, the mixing rate is controlled to be decreased. Due to such control, the tone color variation can be further smoothed.

[B] ELECTRIC CONFIGURATION OF AN EMBODIMENT OF THE PRESENT INVENTION

Figure 1A:
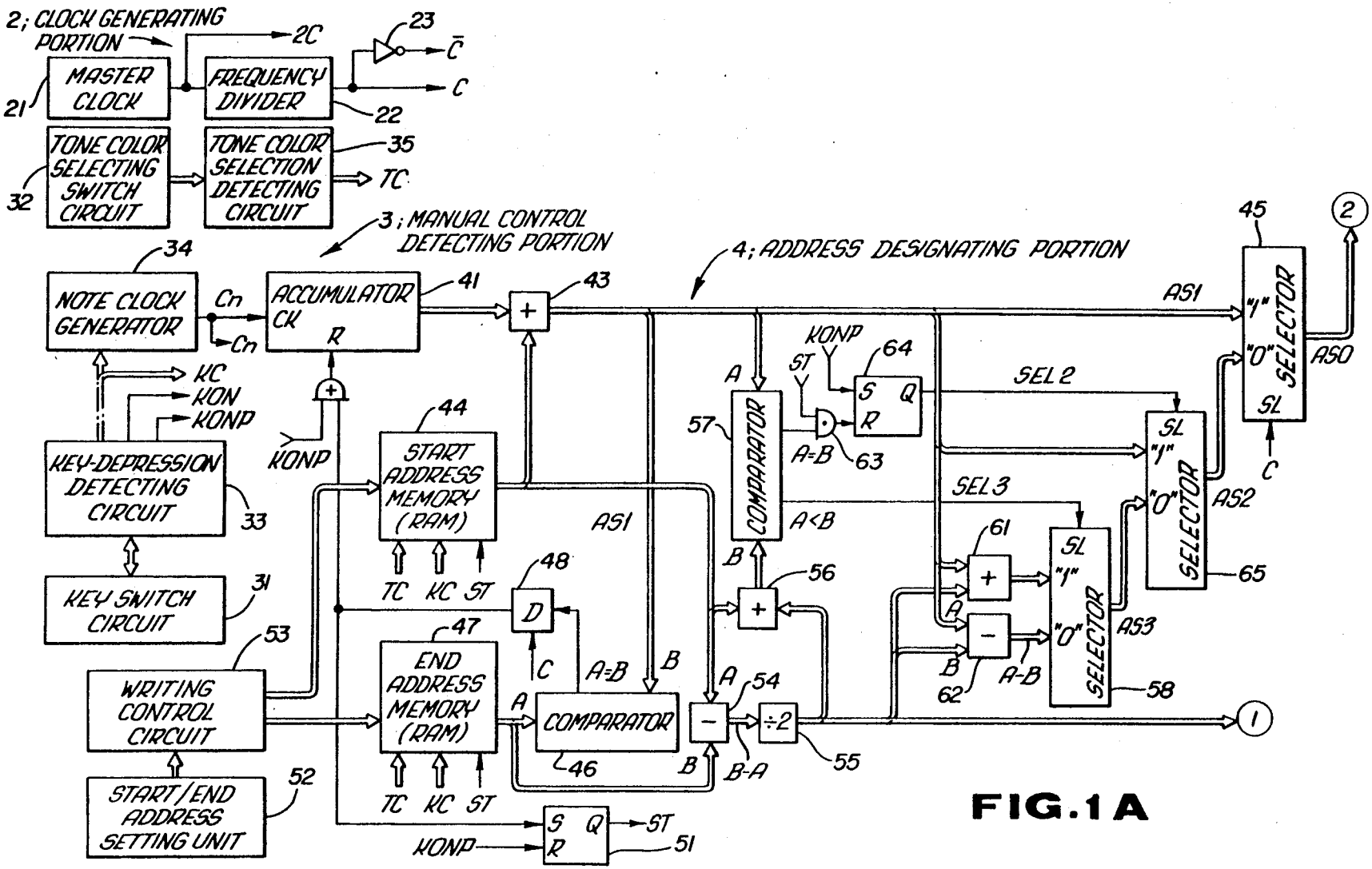
FIGS. 1A and 1B are block diagrams showing an electric configuration of an electronic musical instrument which adopts a musical tone signal generating apparatus according to an embodiment of the present invention.
Figure 1B:
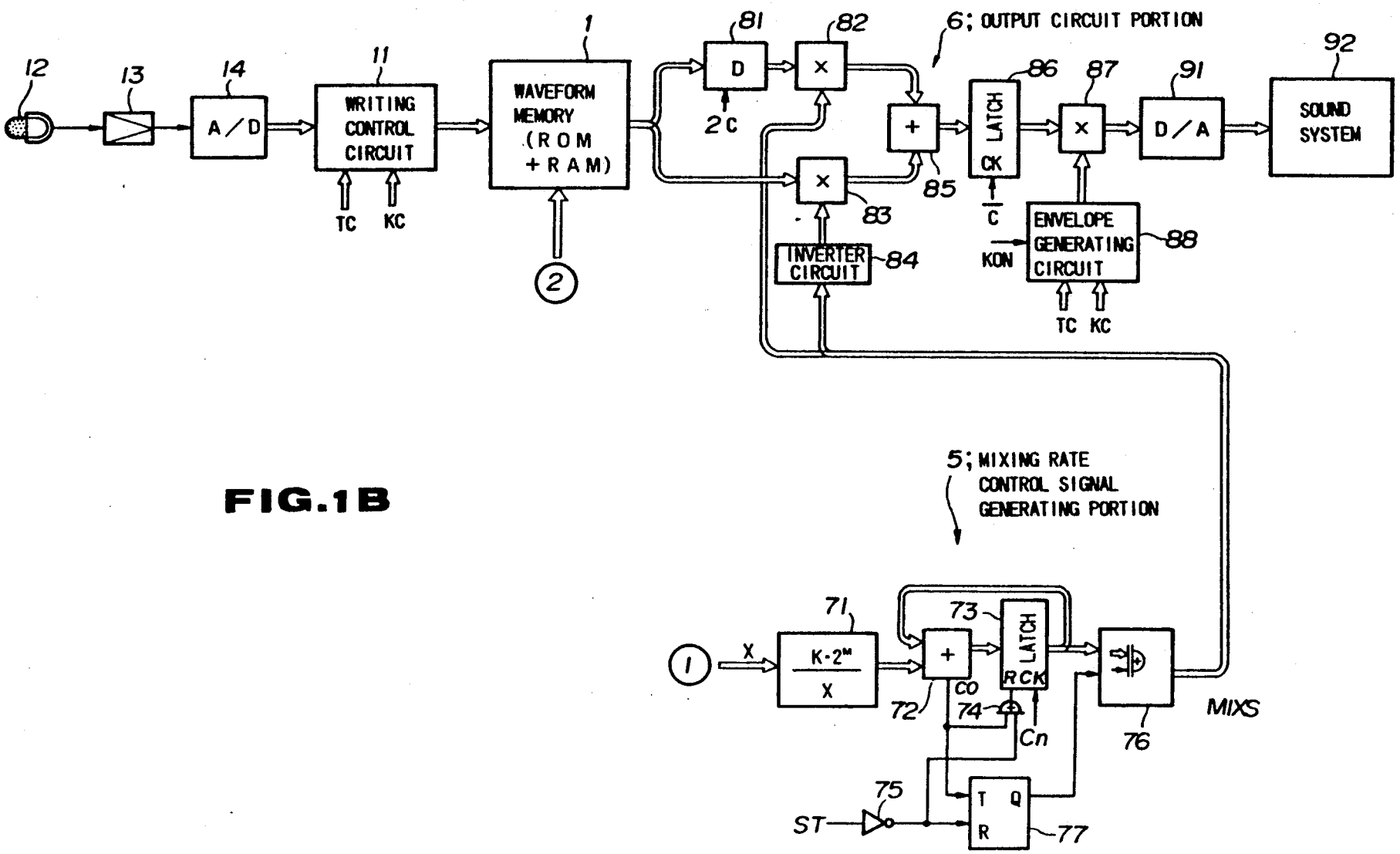

Next, description will be given with respect to the electric configuration of an embodiment of the present invention, wherein FIGS. 1A and 1B are block diagrams showing the keyboard electronic musical instrument which adopts the musical tone signal generating apparatus according to an embodiment of the present invention.

This keyboard electronic musical instrument sequentially reads out the musical tone waveform data stored in a waveform memory 1 (shown in FIG. 1B) in response to operations of manual performance controls such as keys of keyboard, so that it generates the musical tone signal corresponding to the read data. This electronic musical instrument provides a clock generating portion 2 for generating a clock signal for controlling the operation timings thereof; a manual control detecting portion 3 for detecting the operation of foregoing performance manual control; an address designating portion 4 for controlling two series of musical tone waveform data by designating the address of waveform memory 1 with time-sharing system; a mixing rate control signal generating portion 5 for generating a mixing rate control signal MIXS for controlling the mixing rate of two series of musical tone waveform data to be read from the waveform memory 1; and an output circuit portion 6 for mixing the two series of musical tone waveform data together in response to the foregoing mixing rate control signal MIXS to thereby output the mixed data.

Figure 2:
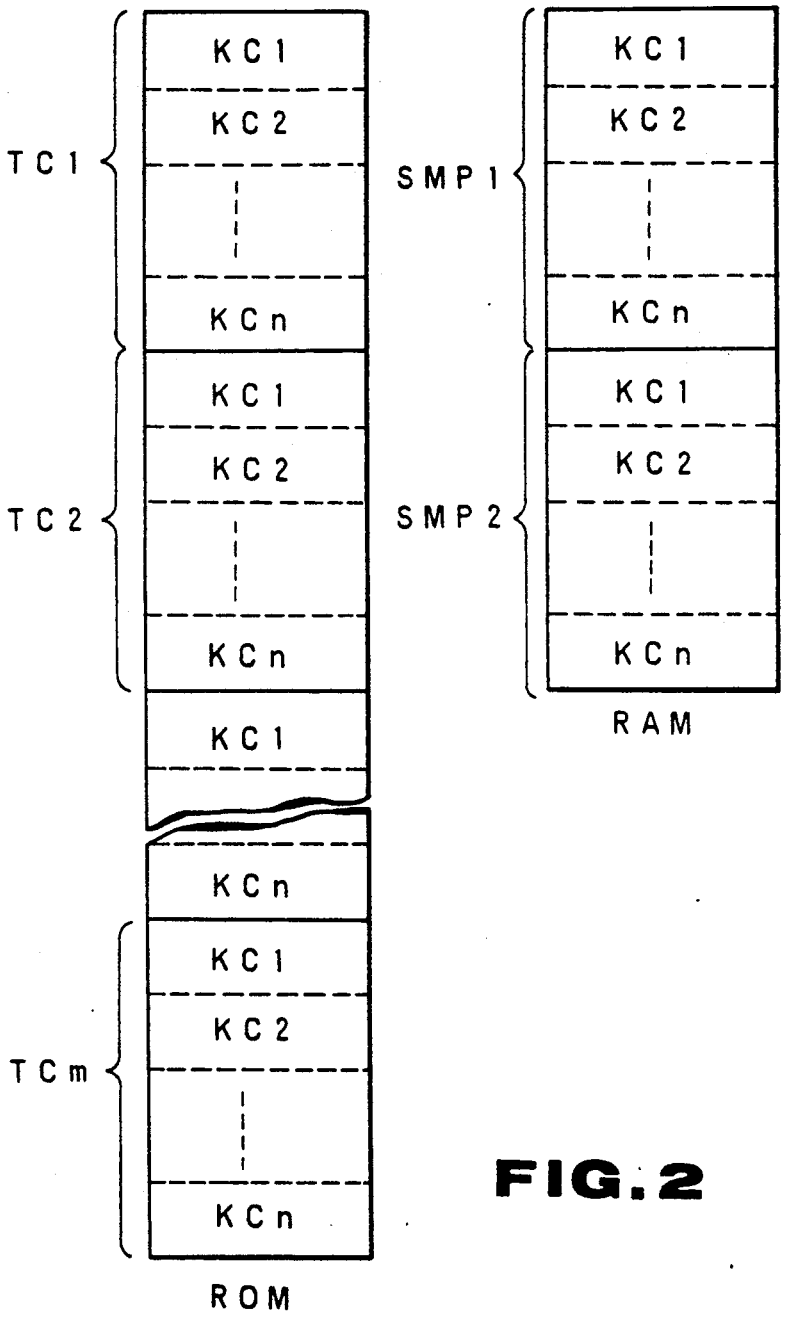
FIG. 2 shows a detailed data format of a waveform memory shown in FIG. 1B.
Figure 3:
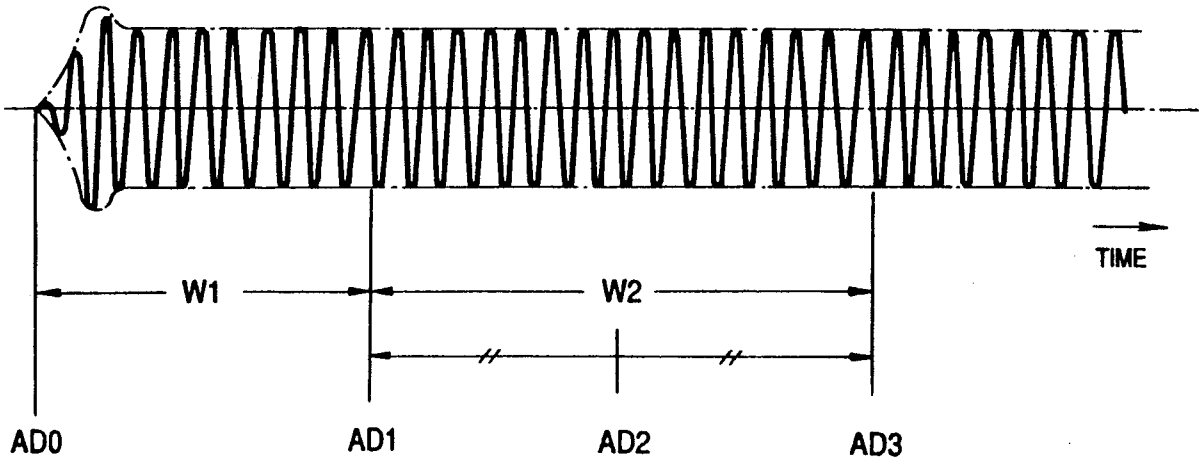
FIG. 3 shows an example of waveform concerning waveform data to be stored in the waveform memory shown in FIG. 1B.

The waveform memory 1 comprises a read-only memory (ROM) and a random-access memory (RAM) as shown in FIG. 2. The storing area of ROM is divided into plural middle areas TC1, TC 2, ..., TCm in response to tone color selectors each designating each of tone colors of piano, violin and the like, and each middle area is further divided into plural small areas KC1, KC2, ..., KCn in response to tone areas within the keyboard (where numbers m and n denote arbitrary natural numbers). Each small area pre-stores the waveform data consisting of a plenty of sampling data each indicating an each instantaneous value of the musical tone waveform whose magnitude is continuous from the rising portion of the musical tone as shown in FIG. 3. Similar to this ROM, the storing area of RAM is also divided into middle areas SMP1 and SMP2, and each middle area is further divided into plural small areas KC1, KC2, ..., KCn. Each small area stores the waveform data consisting of the foregoing sampling data concerning the desirable external tone which is externally picked up by the player. In the present embodiment, each small area stores such waveform data by every tone area.

For this reason, the waveform memory 1 (shown in FIG. 1B) is connected with a writing control circuit 11 by which the waveform data concerning the foregoing external ton is written into the waveform memory 1. In this case, a microphone 12 picks up the external tone and then converts such picked-up external tone into an analog signal This analog signal is converted into a digital signal in an analog-to-digital (A/D) converter 14. Then, this digital signal is supplied to the writing control circuit 11. In addition, this circuit 11 is supplied with a key code KC and a tone color selecting signal TC which are respectively supplied from a key-depression detecting circuit 33 and a tone color selection detecting circuit 35 (shown in FIG. 1A). In response to these key code KC and tone color selecting signal TC, the writing control circuit 11 designates the storing area for storing the waveform data concerning the external tone in the RAM within the waveform memory 1.

The clock generating portion 2 includes a master clock generator 21, a ½ frequency divider 22 and an inverter circuit 23. This clock generating portion 2 generates a first clock signal C having high frequency, an inverted first clock signal $\overline{C}$ and a second clock signal 2C having double frequency of first clock signal C.

The manual control detecting portion 3 provides a key switch circuit 31 including plural key switches each corresponding to each key of keyboard, and a tone color selecting switch circuit 32 including plural tone color selecting switches each corresponding to each tone color selector. The key switch circuit 31 is connected with the key-depression detecting circuit 33 which detects open/close operations of each key switch within the key switch circuit 31 to thereby detect the key-depression of each key of keyboard. This key-depression detecting circuit 33 outputs the key code indicative of the depressed key and a key-on signal KON whose logical value changes to "1" at the key-depression timing but changes to "0" at the key-release timing. Moreover, this circuit 33 differentiates the rising portion of key-on signal KON to thereby generate a key-on pulse signal KONP whose logical value turns to "1" at the key-depression timing. Based on the key code KC supplied from the key-depression detecting circuit 33, a note clock generator 34 generates and then outputs a note clock signal Cn having the frequency which is proportional to the pitch frequency of depressed key. For example, the frequency of this note clock signal Cn is set sufficiently higher than the pitch frequency of depressed key.

Meanwhile, the tone color selection detecting circuit 35 detects the open/close operations of the tone color selecting switch within the tone color selecting switch circuit 32 to thereby detect the operation of tone color selector. Based on the operation of tone color selector, this circuit 35 outputs the tone color selecting signal T indicative of the selected tone color.

The address designating portion 4 provides an accumulator 41 coupled to the note clock generator 34. This accumulator 41 is reset by a pulse signal which is supplied to its reset terminal R via an OR circuit 42. The accumulator 41 accumulates the predetermined values by the timing designated by the note clock signal Cn from the note clock generator 34 which is supplied to a clock input CK thereof. Based on such accumulation, the accumulator 41 outputs a relative address signal corresponds to the phase of musical tone signal waveform shown in FIG. 3. The value of this relative address signal is varied by the rate proportional to the pitch frequency of depressed key so that it will indicate each address of small area within the waveform memory 1. Next, an adder 43 adds the relative address signal from the accumulator 41 with an address signal from a start address memory 44 to thereby calculate an absolute address of the waveform memory 1. Then, the signal indicative of the absolute address is supplied to a first input ("1") of a selector 45 as a first address signal AS1.

The start address memory 44 is configured by the RAM. This memory 44 stores attack start address data AD0 (see FIG. 3) by each small area of the waveform memory 1, wherein this data AD0 indicates the absolute address at which the sampling data concerning the head address thereof, i.e., the tone-generation start timing of the musical tone is stored. In addition, the memory 44 stores repeat start address data AD1 (see FIG. 3) by each small area of the waveform memory 1, wherein this data AD1 indicates the absolute address at which the sampling data corresponding to the start position for repeatedly reading the musical ton waveform data is stored. The reading of these data AD0 and AD1 is controlled by the key code KC, the tone color selecting signal TC and a repeat start signal ST. The repeatedly reading of the waveform data is designated when the repeat start signal ST takes the value "1", while it is designated that the repeatedly reading of the waveform data is stood by when the signal ST takes the value "0". Therefore, when the repeat start signal ST takes the value "0", the reading of the attack start address data AD0 is designated. When the repeat start signal ST takes the value "1", the reading of the repeat start address data AD1 is designated.

The first address signal AS1 from the adder 43 is supplied to a second input of a comparator 46, while an end address signal from an end address memory 47 is supplied to a first input of comparator 46. When the end address signal coincides with the first address signal AS1, the comparator 46 outputs a coincidence signal to a delay circuit (D) 48. Under control of the first clock signal C, the delay circuit 48 delays the coincidence signal by one-bit time. This delayed coincidence signal and the key-on pulse signal KONP are both supplied to the OR circuit 42, whose output is then supplied to the reset terminal R of the accumulator 41. In addition, the delayed coincidence signal from the delay circuit 48 is also supplied to a set terminal S of a flip-flop circuit 51. This flip-flop 51 outputs the foregoing repeat start signal ST from an output terminal Q thereof. Further, the key-on pulse signal KONP is supplied to a reset terminal R of the flip-flop 51.

The end address memory 47 is also configured by the RAM. This memory 47 stores attack end address data (AD1-1) (see FIG. 3) by each small area of the waveform memory 1, wherein the value of this data (AD1-1) is smaller than that of repeat start address data AD1 by "1" so that this data (AD1-1) corresponds to the absolute address indicative of the end portion of attack portion. In addition, the memory 47 stores repeat end address data AD3 (see FIG. 3) by each small area of the waveform memory 1, wherein this data AD3 indicates the absolute address at which the sampling data corresponding to the end position of repeatedly reading the musical tone waveform data is stored. The readings of these data (AD1-1) and AD3 are controlled by the tone color selecting signal TC, the key code KC and the repeat start signal ST. In the present embodiment, the reading of attack end address data (AD1-1) is designated when the repeat start signal ST takes the value "0", while reading of repeat end address data AD3 is designated when this signal takes the value "1".

In order to write and rewrite several data in these start address memory 44 and end address memory 47, a start/end address setting unit 52 and a writing control circuit 53 are provided. The start/end address setting unit 52 provides a ten-key unit and writing control switches, so that this unit 52 outputs address data concerning the memories 44 and 47 and also outputs the data to be written in the memories 44 and 47. Under control of this unit 52, the writing operations of these memories 44 and 47 ar designated. In accordance with such designation by the unit 52, the writing control circuit 53 controls the data to be written into the memories.

Further, outputs (A and B) of these memories 44 and 47 are supplied to a subtractor 54. This subtractor 54, a divider 55 and an adder 56 configures a circuit for computing central address data AD2 corresponding to a central value between the values of repeat start address data AD1 and repeat end address data AD3. More specifically, the subtractor 54 subtracts the repeat start address data AD1 from the repeat end address data AD3 to thereby obtain the subtraction result (AD3-AD1), which is then supplied to the divider 55 wherein such subtraction result is divided by two. This divider 55 outputs its divide result (AD3-AD1)/2 to a first input of the adder 56, while the repeat start address data AD1 is supplied to a second input of the adder 56. This adder 56 adds these data AD1 and (AD3-AD1)/2 together to thereby obtain data (AD3+AD1)/2, which is then outputted to a first input of a comparator 57 as the central address data AD2.

On the other hand, the first address signal AS1 is supplied to a second input of the comparator 57. Then, the comparator 57 outputs a selection signal SEL3 based on its comparison result. More specifically, the value of this selection signal SEL3 turns to "1" in the case where the value of first address signal AS1 is smaller than the value of central address data AD2. In other cases, the value of selection signal SEL3 turns to "0". This selection signal SEL3 is outputted to a selection control terminal SL of a selector 58. Thus, the selector 58 selectively outputs a signal supplied to a first input ("1") thereof as a third address signal AS3 when the selection signal SEL3 takes the value "1", while the selector 58 selectively outputs another signal supplied to a second input ("0") thereof as the third address signal AS3 when the selection signal SEL3 takes another value "0". These first and second inputs of selector 58 are respectively supplied with outputs of an adder 61 and a subtractor 62. The adder 61 inputs and then adds the first address signal AS1 and the signal (indicative of the data [AD3-AD1]/2=AD2-AD1) together to thereby generate an address signal whose phase is a half period of the repeating segment forward as compared to the phase of first address signal AS1. The subtractor 62 subtracts the value of data (AD3-AD1)/2 outputted from the divider 55 from the value of first address signal AS1 to thereby generate another address signal whose phase is a half period of the repeating segment behind as compared to the phase of first address signal AS1.

Meanwhile, the foregoing comparator 57 outputs a coincidence signal to a first input of an AND circuit 63, wherein the value of this coincidence signal turns to "1" when the value of first address signal AS1 coincides with the value of central address data AD2. On the other hand, the repeat start signal ST from the flip-flop 51 is supplied to a second input of this AND circuit 63. Then, the output of AND circuit 63 is supplied to a reset terminal R of a flip-flop 64. In addition, the key-on pulse signal from the key-depression detecting circuit 33 is supplied to a set terminal S of this flip-flop 64. This flip-flop circuit 64 supplied its output from a terminal Q thereof to a selection control terminal SL of a selector 65 as a selection signal SEL2. This selector 65 is also configured as similar to the foregoing selector 58. More specifically, the selector 65 selectively outputs the first address signal AS1 supplied to the first input ("1") thereof as the second address signal AS2 when the selection signal SEL2 takes the value "1", while the selector 65 selectively outputs the third address signal AS3 supplied to the second input ("0") thereof as the second address signal AS2 when the selection signal SEL2 takes the value "0". Such second address signal AS2 is outputted to a second input ("0") of selector 45.

This selector 45 is also configured as similar to other selectors 58 and 65. In addition, the first clock signal C is supplied to a selection control terminal SL of selector 45 as its selection signal. More specifically, the selector 45 selectively outputs the first address signal AS1 supplied to the first input ("1") thereof when its selection signal takes the value "1", while the selector 45 selectively outputs the second address signal AS2 supplied to the second input ("0") thereof when its selection signal takes the value "0". Such selective output of the selector 45 is supplied to the waveform memory 1 (shown in FIG. 1B) as an output address signal AS0. Since the first clock signal C is supplied to the selector 45 as the selection signal, one of the first address signal AS1 and second address signal AS2 is selectively outputted by a half period of first clock signal C based on time sharing system as the output address signal AS0.

In FIG. 1B, the mixing rate control signal generating portion 5 provides an arithmetic logical unit 71. The divider 55 (see FIG. 1A) outputs data X having the value (AS2-AS1) indicative of a half period of the repeating segment. This data X is supplied to the arithmetic logical unit 71. Meanwhile, the output of this unit 71 has a variety range $2^M$. The arithmetic logical unit 71 operates a calculation of $K \cdot 2^M/X$ to thereby obtain a increment value which is in inverse proportion to the value corresponding to the period of repeating segment. In this calculation, the coefficient K is set as the proportional constant by which the value of mixing rate control signal MIXS will be increased to the maximum value "$2^M-1$" when the increment values are accumulated by every period of the note clock signal Cn in a half period of the repeating segment. In addition, the constant M means the bit number of an adder 72, a latch circuit 73 and an inverter 76 as well as the bit number of mixing rate control signal MIXS.

The adder 72 and latch circuit 73 configures an accumulator to which the increment value outputted from the arithmetic logical unit 71 is supplied. The adder 72 adds the increment value with the output value of latch circuit 73, and then the addition result thereof is supplied to the latch circuit 73. In addition, the adder 72 generates and outputs a carry signal CO to a first input of OR circuit 74 so that this carry signal CO will be supplied to a reset terminal R of the latch circuit 73. Meanwhile, the repeat start signal ST from the flip-flop circuit 51 is inverted by an inverter 75, so that such inverted signal is supplied to a second input of OR circuit 74. Thus, the latch circuit 73 is reset when the signal supplied to its reset terminal R takes the value "1", while the latch circuit 73 latches the addition result of the adder 72 every time the note clock signal Cn is supplied to its clock input CK. As a result, the output of latch circuit 73 has the value which varies between "0" and "$2^M-1$" by every half period of the repeating segment.

Figure 4:
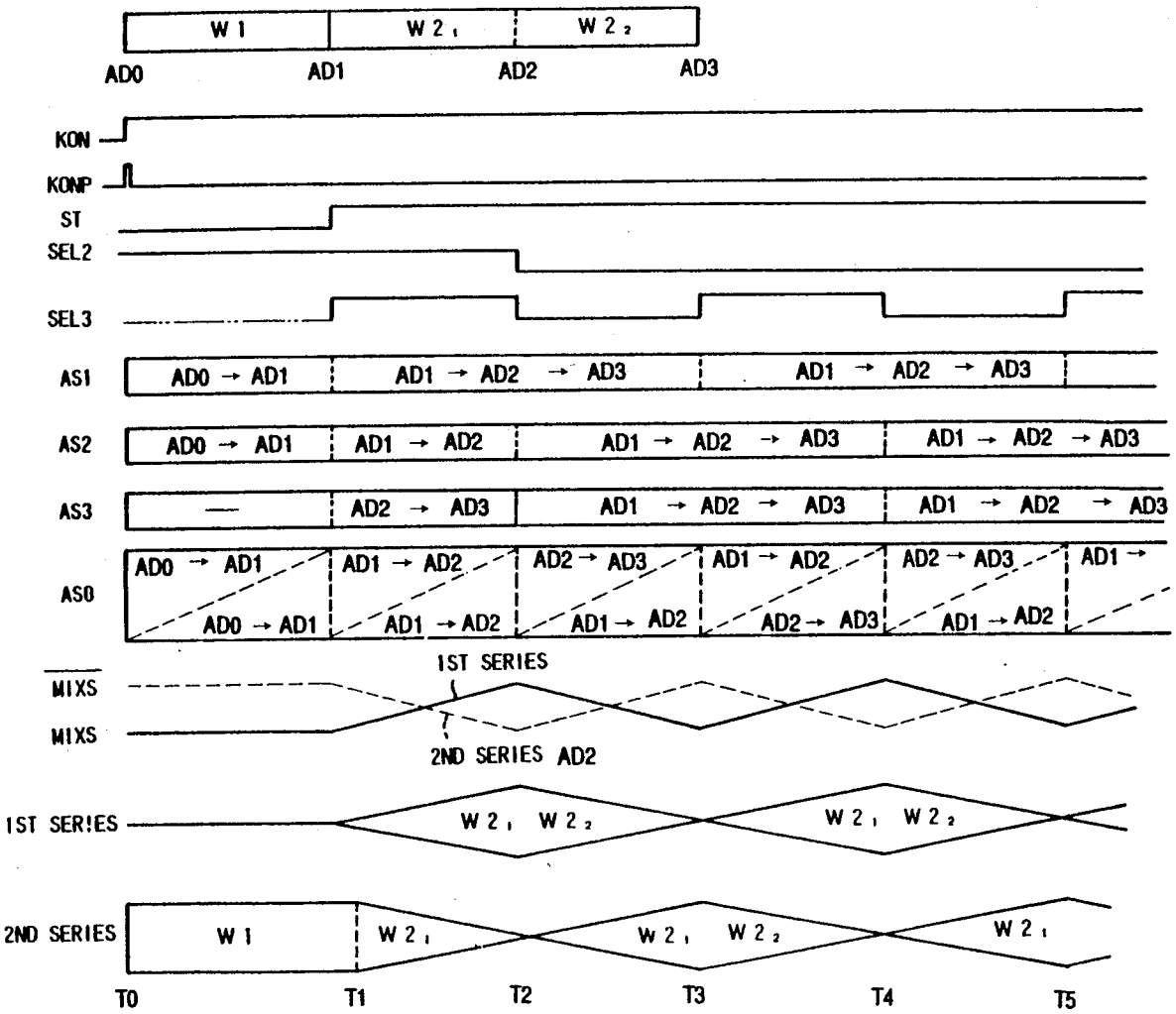
FIG. 4 is a time chart for explaining operations of the electronic musical instrument shown in FIGS. 1A and 1B.

Then, the data of M bits outputted from the latch circuit 73 is supplied to a first input of an inverter unit 76 which is configured by an exclusive OR gate. On the other hand, a signal outputted from an output terminal Q of a flip-flop 77 is supplied to a second input of the inverter unit 76. This inverter unit 76 outputs the input data thereof as it is when this signal supplied to the second input thereof takes the value "0". When this signal takes the value "1", the inverter unit 76 inverts the value of every bit in its input data and then outputs such inverted data. Meanwhile, the inverted signal outputted from the inverter 75 is supplied to a reset terminal R of the flip-flop circuit 77, while the carry signal CO from the adder 72 is supplied to an inversion input terminal T of the flip-flop circuit 77. When the value of repeat start signal ST is varied to "1", the reset state of flip-flop circuit 77 is released, so that the operation of the flip-flop circuit 77 is controlled to be inverted by every half period of the repeating segment under effect of the carry signal CO. Thus, as shown in FIG. 4, the waveform of mixing rate control signal MIXS is varied as a triangular wave by every period of the repeating segment.

Next, in the output circuit portion 6, the first and second series of waveform data read from the waveform memory 1 are spatially separated, and then an interpolation corresponding to the mixing rate control signal MIXS is operated on the separated waveform data. In this output circuit portion 6, a delay circuit 81 and a multiplier 82 is provided for the first series of waveform data, while only a multiplier 83 is provided for the second series of waveform data. The delay circuit 81 delays the waveform data by a half period of the first clock signal C based on the second clock signal 2C supplied thereto. Then, the multiplier 82 multiplies the value of the delayed waveform data and the value of mixing rate control signal MIXS together. On the other hand, the multiplier 83 multiplies the value of waveform data and a value of output signal of an inverter circuit 84 together. This inverter circuit 84 is configured by plural inverters whose number corresponds to the bit number M. More specifically, the inverter circuit 84 inverts every bit value of the mixing rate control signal MIXS to thereby output an inverted mixing rate control signal $\overline{\text{MIXS}}$ (i.e., one's complement of the mixing rate control signal MIXS) as shown by the dotted line in FIG. 4.

Thereafter, the adder 85 adds the multiplication results of the multipliers 82 and 83 together, so that the addition result to be obtained is supplied to a latch circuit 86. This latch circuit 86 latches the mixed waveform data outputted from the adder 85 in synchronism with the inverted first clock signal $\overline{C}$. Then, the latch circuit 85 outputs the latched waveform data by every latter half period of the first clock signal C.

The output (i.e., waveform data signal) of latch circuit 86 is supplied to a first input of multiplier 87, while an envelope waveform signal outputted from an envelope generating circuit 88 is supplied to a second input of multiplier 87. Thus, the multiplier 87 multiplies the above waveform data signal and envelope waveform signal together. In response to the key-on signal KON from the key-depression detecting circuit 33, the envelope generating circuit 88 generates the envelope waveform signal indicative of an amplitude envelope waveform of the musical tone to be generated. In addition, the envelope generating circuit 88 is also supplied with the key code KC from the key-depression detecting circuit 33 and the tone color selection signal TC from the tone color selection detecting circuit 35. Thus, the waveform of the envelope waveform signal outputted from the envelope generating circuit 88 can be controlled to be varied in response to the selected ton color and selected tone area of musical tone.

The digital output of multiplier 87 is converted into an analog signal in a digital-to-analog (D/A) converter 91, and then such analog signal is supplied to a sound system 92. The sound system 92 includes an amplifier and a speaker, so that the sound system 92 generates the musical tone corresponding to the analog signal supplied thereto.

[C] OPERATION OF EMBODIMENT

Next, description will be given with respect to the operation of the present embodiment.

In the case where the player wants to utilize the desirable external tone in the performance, the player operates the tone color selectors so that the middle area of waveform memory 1 (i.e., either one of the middle areas SMP1 and SMP2 provided in the RAM shown in FIG. 2) will be designated. In addition, by depressing the keys of keyboard, the corresponding small areas within the designated middle area (i.e., the small areas KC1, KC2, ..., KCn provided within the RAM shown in FIG. 2) can be designated. After these operations, the external tone is picked up by the microphone 12. This picked-up external tone is converted into the digital signal consisting of sample data in the A/D converter 14. Then, under control of the writing control circuit 11, such sample data is written into the small area within the waveform memory 1. After this writing operation, the player sequentially varies and then designates the small areas within the designated middle area by operating the keyboard so that plural sample data each having the different tone pitch are respectively written into the different small areas. By repeating such operations, several sampling data concerning the external tones having several tone areas will be written into the waveform memory 1. This repeating operations may not be required when the external tones having the different tone areas are not required, or when it is impossible to write the sampling data concerning plural external tones because the waveform memory provides only one small area.

Next, the player designates the repeating segment of the waveform data which are stored in the waveform memory 1. In such case, the player can designate the waveform data by the operations of tone color selectors and keyboard, wherein each waveform data is stored in the waveform memory 1 by each tone color and each tone area (or key area). After designating the waveform data, the player inputs the values of the repeat start address data AD1 and repeat end address data AD3 by use of the start/end address setting unit 52. Then, the writing control circuit 53 calculates the attack end address data (AD1-1) base on the inputted repeat start address data AD1. These data AD1 and (AD1-1) are written into the start address memory 44, while the data AD3 and (AD1-1) are written into the end address memory 47. In this case, the writing addresses of these memories 44 and 47 are designated by the tone color selecting signal TC from the tone color selection detecting circuit 35 and the key code KC from the key-depression detecting circuit 33. Incidentally, the attack start address data AD0 is automatically determined in response to the divided areas of waveform memory 1. This data AD0 is written at the initial setting of the electronic musical instrument. At this initial setting, the values of address data AD1, AD3 and AD1-1 are respectively set as normal values by the player. As a result, the present embodiment can save much time and labor because the settings can be completed by only setting the repeating segment concerning the waveform data to be varied.

After the above-mentioned preparation, when the player operates the tone color selectors and keyboard to thereby start the performance of electronic musical instrument, the operation of tone color selector is detected by the tone color selecting switch circuit 32 and tone color selection detecting circuit 35, so that this circuit 35 generates the tone color selecting signal TC. On the other hand, the key-operations of the keyboard are detected by the key switch circuit 31 and key-depression detecting circuit 33. Thus, the key-depression detecting circuit 33 outputs the key code KC indicative of the depressed key, the key-on signal KON and key-on pulse signal KONP, wherein the levels of these signals KON and KONP both rise up to "1" level at the key-depression timing. Hereafter, description will be given with respect to the generation of musical tone signal in response to the performance by referring to the time chart shown in FIG. 4. In FIG. 4, the moment when the key of the keyboard is depressed is designated by TO.

Due to the key-depression, the note clock generator 34 outputs the note clock signal Cn corresponding to the key code KC to the accumulator 41. After being reset by the key-on pulse signal KONP, the accumulator 41 generates a relative address signal whose value varies by a rate corresponding to the pitch frequency of the depressed key in the keyboard. In addition, this key-on pulse signal KONP resets the flip-flop 51 at the key-depression timing, so that the level of repeat start signal ST outputted from the flip-flop circuit 51 falls down to "0" level. As a result, the start address memory 44 outputs the attack start address data AD0 and the end address memory 47 outputs the attack end address data (AD1-1), wherein these two data concern the selected tone color and the tone area of depressed key which are respectively indicated by the tone color selecting signal TC and the key code KC. Then, the adder 43 adds the value of attack start address data AD0 with the value of relative address signal from the accumulator 41 to thereby generate the first address signal AS1. This first address signal AS1 indicates the absolute address for designating the address of waveform data W1 in the attack portion (see FIGS. 3 and 4), wherein this absolute address is set between the addresses indicated by the data AD0 and AD1.

Meanwhile, the key-on signal KON sets the flip-flop circuit 64 at this time, so that this flip-flop circuit 64 outputs the selection signal SEL2 having "1" level to the selector 65. Due to this selection signal SEL2, the selector 65 supplies the first address signal AS1 to the second input ("0") of selector 45 as the second address signal AS2. At this time, the first address signal AS1 from the adder 43 is also directly supplied to the first input ("1") of selector 45. Thus, the selector 45 supplies the output address signal AS0 to the waveform memory 1 as the first address signal AS1 in the whole period (including the former half period and latter half period) of the first clock signal C.

Under the above-mentioned operations, the waveform data W1 corresponding to the attack portion of musical tone waveform is read from the waveform memory 1 as first and second series of waveform data in both of the former half period and latter half period of the first clock signal C. Then, the waveform data W1 which is outputted as the first series of waveform data is delayed by a half period of the first clock signal C in the delay circuit 81, and such delayed waveform data is multiplied by the mixing rate control signal MIXS in the multiplier 82. In addition, the waveform data W1 which is outputted as the second series of waveform data is directly supplied to the multiplier 83 wherein this waveform data is multiplied by the inverted mixing rate control signal $\overline{\text{MIXS}}$. For this reason, the mixing rate control signal MIXS indicates the mixing rate of the first series of waveform data, while the inverted mixing rate control signal $\overline{MIXS}$ indicates the mixing rate of the second series of waveform data. Thereafter, these two multiplication results are added together in the adder 85, whose output is then latched in the latch circuit 86 by the timing of latter half period of the first clock signal C. Meanwhile, the repeat start signal ST having "0" level is inverted by the inverter 75, and then the inverted repeat start signal resets the latch circuit 73 and flip-flop circuit 77 in the mixing rate control signal generating portion 5. In this case, the mixing rate control signal MIXS takes the value "0", while the inverted mixing rate control signal $\overline{MIXS}$ takes the value "$2^M-1$". Therefore, the waveform data W1 which is outputted as the second series of waveform data will be directly outputted from the waveform memory 1. In this case, however, the sampling data stored in the waveform memory 1 is standardized by the data "$2^M-1$" which corresponds to the maximum value of the mixing rate control signal MIXS.

Next, the waveform data W1 latched in the latch circuit 86 is multiplied by the envelope waveform signal outputted from the envelope generating circuit 88 in the multiplier 87. Thereafter, the digital signal indicative of the multiplication result of the multiplier 87 is converted into the analog signal in the D/A converter 91. This analog signal is supplied to the sound system 92. As a result, the sound system 92 will generate the musical tone which is obtained by applying the amplitude envelope to the waveform data W1.

Due to the increase of the accumulation value of the accumulator 41, the value of first address signal AS1 outputted from the adder 43 becomes equal to that of the attack end address data outputted from the end address memory 47 at time T1 when the repeat start signal ST takes the value "0". At this time T1, the comparator 46 output the coincidence signal. This coincidence signal is delayed by one period of the first clock signal C by the delay circuit 48. Thereafter, such delayed coincidence signal is supplied to the reset terminal R of the accumulator 41 via the OR circuit 42, and this signal is also supplied to the set terminal S of the flip-flop circuit 51. Thus, the accumulator 41 re-starts to output the relative address signal whose value is sequentially increased from "0". In addition, the flip-flop circuit 51 starts to output the repeat start signal ST indicative of value "1". Afterwards, the start address memory 44 and end address memory 47 respectively output the repeat start address data AD1 and repeat end address data AD3.

This repeat start signal ST indicative of value "1" is inverted to the signal indicative of value "0" by the inverted 75. Then, in the mixing rate control signal generating portion 5, such inverted signal is supplied to the reset terminal R of the latch circuit 73 via the OR circuit 74, and such inverted signal is also supplied to the reset terminal R of the flip-flop circuit 77. Therefore, this inverted signal resets both of the latch circuit 73 and flip-flop circuit 77. Thereafter, the accumulator configured by the latch circuit 73 and added 72 outputs a sawtooth waveform signal whose value repeatedly varies between "0" and "$2^M-1$" by ever half period of the repeating segment (corresponding to the period of AD1 to AD2 or AD2 to AD3). Due to the reset by the repeat start signal ST and the inverting control by the carry signal CO from the adder 72, the flip-flop circuit 77 supplies its output signal to the second input of inverter circuit 76, wherein the value of this output signal is controlled to be inverted by every half period of the repeating segment. More specifically, the output of flip-flop circuit 77 takes value "0" in the former half period and also takes value "1" in the latter half period of the repeating segment. Therefore, the mixing rate control signal MIXS (which is the triangular waveform signal as show in FIG. 4) outputted from the inverter circuit 76 repeatedly varies between "0" and "$2^M-1$" in the repeating segment (corresponding to the variation period of AD1 to AD3) after the repeat start signal ST turns to "1".

When the repeat start signal ST turns to "1", the accumulator 41 is reset. Thereafter, the accumulator 41 re-starts to perform its accumulation operation and the start address memory 44 generates the repeat start address data AD1, so that the adder 43 starts to output the first address signal AS1 indicative of the absolute addresses AD1 to AD3 which are used for reading the waveform data W2 corresponding to the repeating segment, and this first address signal AS1 is supplied to the first input ("1") of selector 45. Hereinafter, the former part of waveform data W2 is indicated by $W2_1$ and the latter part thereof is indicated by $W2_2$. In this state, the flip-flop circuit 64 is subjected to the set state, so that the selector 65 selectively outputs the first address signal AS1 to the second input ("0") of selector 45 as the second address signal AS2. Thus, the selector 45 supplies the output address signal AS0 to the waveform memory 1 during the whole period of the first clock signal C. As a result, the same waveform data $W2_1$ is read from the waveform memory 1 in both of the former half period (corresponding to the first series) and the latter half period (corresponding to the second series) of the first clock signal C. In addition, the addition value of the mixing rate control signal MIXS and inverted mixing rate control signal $\overline{MIXS}$ must indicate the value "$2^M-1$", so that the waveform data $W2_1$ will be outputted as it is. Thus, the sound system 92 generates the musical tone corresponding to the waveform data $W2_1$.

In the above-mentioned state, the value of first address signal AS1 becomes equal to the value of central address data AD2 indicative of the central address in the repeating segment at time T2. Accordingly, the comparator 57 which inputs the first address signal AS1 and central address value AD2 will supply the coincidence signal (having value "1") to the first input of AND circuit 63. Since the repeat start signal ST having value "1" is supplied to the second input of AN circuit 63, the flip-flop circuit 64 is reset by the coincidence signal from the comparator 57. As a result, the value of selecting signal SEL2 from the flip-flop circuit 64 turns to "0". Due to such selecting signal SEL2 supplied to the selection control terminal SL of the selector 65, the selector 65 selectively outputs the third address signal AS3 from the selector 58 as the second address signal AS2.

Meanwhile, after the comparator 57 outputs the coincidence signal, the value of first address signal AS1 becomes larger than the central address value AD2, so that the selecting signal SEL3 indicates the value "0". Accordingly, the selector 58 outputs the signal from the subtractor 62, wherein this signal is the address signal (corresponding to AD1 to AD2) which is delayed by a half period of the repeating segment as compared to the first address signal AS1. Such address signal is supplied to the second input ("0") of selector 45 via the selectors 58 and 65 as the second address signal AS2. On the other hand, the first address signal AS1 is supplied to the first input ("1") of selector 45, wherein the value of this first address signal AS1 varies between the central address value AD2 and repeat end address value AD3. Therefore, the output address signal AS0 from the selector 45 takes the value which varies from AD2 to AD3 in the former half period and then varies from AD1 to AD2 in the latter half period of the first clock signal C. Due to such output address signal AS0 supplied to the waveform memory 1, the waveform data $W2_2$ is read out as the first series of waveform data in the former half period, while the waveform data $W2_1$ is read out as the second series of waveform data in the latter half period of the first clock signal C.

In the above case, the value of mixing rate control signal MIXS outputted from the mixing rate control signal generating portion 5 is decreasing from "$2^M-1$" to "0". In contrast, the inverted mixing rate control signal $\overline{MIXS}$ outputted from the inverter circuit 84 is increasing from "0" to "$2^M-1$". In addition, the latch circuit 86 latches the output of adder 85 in the latter half period of the first clock signal C. Thus, under control of the mixing circuit consisting of the delay circuit 81, multipliers 82, 83, adder 85 and latch circuit 86, the mixing rate of waveform data $W2_2$ as the first series of waveform data is gradually decreasing in the lapse of time, while another mixing rate of waveform data $W2_1$ as the second series of waveform data is gradually increasing in the lapse of time. These waveform data $W2_1$ and $W2_2$ are mixed together, so that the musical tone corresponding to the mixed waveform data is generated.

Thereafter, the value of first address signal AS1 from the adder 43 becomes equal to the repeat end address data value AD3 at time T3. As a result, the comparator 46 outputs the coincidence signal again. This coincidence signal resets the accumulator 41 via the delay circuit 48 and OR circuit 42. Therefore, as described before, the accumulator 41 outputs the relative address signal whose value is sequentially increased from "0". This relative address signal is added with the repeat start address data AD1 from the start address memory 44, so that this relative address signal is converted to the absolute address whose value varies from AD1 to AD3. Then, such absolute address signal is supplied to the first input ("1") of selector 45.

Meanwhile, this first address signal AS1 is also supplied to the comparator 57 wherein this first address signal AS1 is compared with the central address value AD2 from the adder 56. When the value of first address signal AS1 is smaller than the central address value AD2, the level of selecting signal SEL3 turns to "1". Therefore, the signal (AD2 to AD3) outputted from the adder 61 is supplied to the second input ("0") of selector 45 as the second address signal AS2 via the selectors 58 and 65, wherein this signal has the phase which is advanced by the phase corresponding to a half period of the repeating segment as compared to the phase of first address signal AS1. Thus, the selector 45 outputs the output address signal AS0 whose value varies from AD1 to AD2 in the former half period (corresponding to the first series) and then varies from AD2 to AD3 in the latter half period (corresponding to the second series) of the first clock signal C. Such output address signal AS0 is supplied to the waveform memory 1, from which the waveform data $W2_1$ is read as the first series of waveform data in the former half period and the waveform data $W2_2$ is read as the second series of waveform data in the latter half period of the first clock signal C.

At this time, the mixing rate control signal MIXS increases from "0" to "$2^M-1$", while the inverted mixing rate control signal $\overline{MIXS}$ decreases from "$2^M-1$" to "0". Under control of the foregoing mixing circuit, the mixing rate of the waveform data $W2_1$ as the first series of waveform data is gradually increased in the lapse of time, while another mixing rate of the waveform data $W2_2$ as the second series of waveform data is gradually decreased. Then, these waveform data $W2_1$ and $W2_2$ are mixed together. Therefore, the sound system 92 generates the musical tone corresponding to the mixed waveform data.

Afterwards, the value of first address signal AS1 varies between AD2 and AD3 so that it becomes larger than the central address data value AD2 at time T4. At this time, the value of selecting signal SEL3 to be supplied to the selector 58 turns to "0". Thus, the address signal (AD1 to AD2) from the subtractor 62 is supplied to the second input ("0") of selector 45 via the selectors 58 and 65, and simultaneously, the value of mixing rate control signal MIXS turns to gradually decrease from "$2^M-1$" to "0". As described before, under control of the foregoing mixing circuit, the mixing rate of the waveform data $W2_2$ as the first series of waveform data is gradually decreased in the lapse of time, while another mixing rate of the waveform data $W2_1$ as the second series of waveform data is gradually increased in the lapse of time. Then, the sound system 92 will generate the musical tone corresponding to the mixture of these waveform data $W2_1$ and $W2_2$.

Thereafter, the first and second series of waveform data are mixed together such that mixing rate of waveform data $W2_1$ is gradually increased but that of waveform data $W2_2$ is gradually decreased. Then, the musical tone corresponding to the mixture of these two waveform data will be continuously generated. When the depressed key of the keyboard is released, the level of key-on signal KON turns to "0" so that the envelope generating circuit 88 outputs the envelope waveform signal whose value is attenuated. Such attenuated envelope waveform is applied to the musical tone to be generated. Thus, the level of the generating musical tone is attenuated (or muted) to zero-level.

As described heretofore, according to the present embodiment, the waveform data W2 (i.e., $W2_1+W2_2$) corresponding to the repeating segment is read from the waveform memory 1 based on time-sharing system as two series of waveform data under control of the address designating portion 4, wherein these two series of waveform data are shifted by a half period of the repeating segment to each other. Then, the output circuit portion 6 mixes these two series of waveform data together in response to the mixing rate cOntrol signal MIX from the mixing rate control signal generating portion 5. In this case, after reading out the sampling data corresponding to the repeat end address AD3, the sampling data corresponding to the repeat start address AD1 is started to be read out. At this time, the discontinuity due to the transfer between the readings of these two sampling data can be smoothed, so that the tone color variation of the musical tone to be generated can be smoothed. As a result, there is no need to process the sampling data stored in the waveform memory 1 in advance, so that the time and labor concerning such processing can be saved. In addition, even when the waveform data (i.e., sampling data) concerning the external tone picked up from the microphone 12 is stored as it is, it is possible to obtain the musical tone whose tone color can be varied smooth. Further, by arbitrarily setting the repeating segment by use of the start/end address setting unit, it is possible to obtain the musical tone having the great variety but whose tone color can be varied smooth.

[D] MODIFIED EXAMPLES OF PRESENT EMBODIMENT

It is possible to modify the present embodiment into several examples as below.

(1) In the present embodiment, when the repeating segment is set by the start/end address setting unit 52, the repeat start address data AD1 and repeat end address data AD3 are designated by the absolute address of the waveform memory 1. However, it is possible to designate these data by the relative address of each small area within the waveform memory 1. In this case, the conversion process of address data in the address generating portion 4 is performed by the relative addresses, and then the relative address data to be processed is converted into the absolute address data of the waveform memory 1 by use of the tone color selection signal TC and key code KC before supplied to the waveform memory 1.

(2) In the present embodiment, both of the repeat start address data AD1 and repeat end address data AD3 can be arbitrarily varied. However, it is possible to arbitrarily vary one of these two data AD1 and AD3.

In addition, the present embodiment sets these data AD1 and AD3 by inputting the numbers. However, it is possible to provide several data for each of these data AD1 and AD3 so that the player can arbitrarily select any one of these several data.

Figure 5:
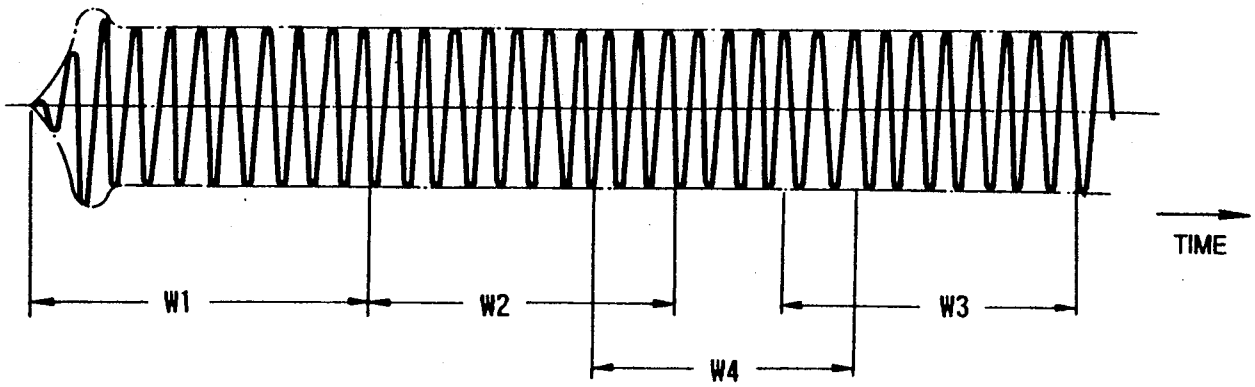
FIG. 5 shows a musical tone waveform which is used in a modified example of the embodiment.

Further, the present embodiment provides only one repeating segment. However, it is possible to provide two or more repeating segments as shown in FIG. 5. In this case the waveform data W2, W3, W4 of each repeating segment can be repeatedly read out. The repeating times of each waveform data can be fixed other than that of the lastly repeated waveform data. Of course, such repeating times can be arbitrarily set by the player.

Figure 6:
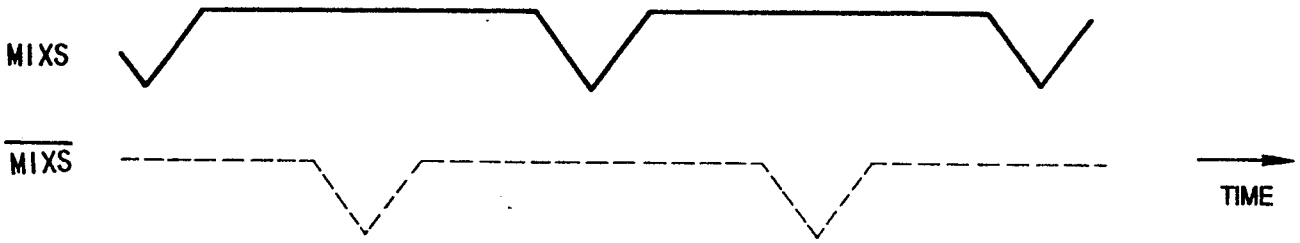
FIG. 6 shows waveforms of a mixing rate control signal in the modified example of the embodiment.

(3) The present embodiment varies the waveform of the mixing rate control signal MIXS as the triangular waveform. However, it is possible to vary the waveform of signal MIXS can be varied as the trapezoidal waveform as shown by the solid line in FIG. 6. In this case, the mixing rate of the first series of waveform data is varied by such trapezoidal waveform signal, while the mixing rate of the second series of waveform data is varied by the signal $\overline{\text{MIXS}}$ as shown by the dotted line in FIG. 6, wherein the phase of this signal $\overline{\text{MIXS}}$ is delayed by the phase shift between the first and second series as compared to that of the above trapezoidal waveform signal.

In addition, the mixing rate control signal MIXS is generated by the calculation of the mixing rate control signal generating portion 5 in the present embodiment. However, it is possible to generate such signal MIXS by another method. For example, a memory for storing the waveform data concerning the foregoing triangular waveform and trapezoidal waveform is provided within the mixing rate control signal generating portion 5. Then, the reading operation of this memory is controlled by the note clock signal Cn, so that the signal read from this memory is outputted as the new mixing rate control signal MIXS.

(4) The present embodiment describes the musical tone signal generating apparatus which is applied to the monophonic keyboard electronic musical instrument. However it is possible to apply the musical tone signal generating apparatus according to the present invention to the polyphonic musical instrument or another equipment without the keyboard but having the tone source unit only whose tone generation is controlled in response to the pitch information supplied from the external device. Further, it is possible to apply the present apparatus to the rhythm unit which generates the rhythm tones of the percussive musical instrument.

(5) The present embodiment configures the manual control detecting portion 3, address designating portion 4, mixing rate control signal generating portion 5 and output circuit portion 6 by the hardware. However, it is possible to perform the processings of these circuit portions by use of the software which will be executed by the microcomputer and the like.

This invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone signal generating apparatus comprising:

(a) memory means for storing musical tone waveform data indicative of plural cycles of a musical tone waveform, said musical tone waveform being divided into several segments each designated by a front address and an end address, wherein a reading operation of said memory means is controlled by designating addresses;

(b) first reading means for repeatedly reading out said musical tone waveform data of a predetermined segment from said memory means by repeatedly designating addresses between said front and end address corresponding to said predetermined segment, so that said musical tone waveform data read by said first reading means is outputted as first musical tone waveform data;

(c) second reading means for repeatedly reading out said musical tone waveform data of said predetermined segment by shifting designation timings of the addresses between said front and end addresses corresponding to said predetermined segment with a predetermined shifting time, so that said musical tone waveform data read by said second reading means is outputted as second musical tone waveform data; and (d) mixing means for mixing said first musical tone waveform data and said second musical tone waveform data together by a mixing rate, whereby a musical tone signal is generated in response to mixed musical tone waveform data outputted from said mixing means.

2. A musical tone signal generating apparatus according to claim 1 wherein said mixing rate is controlled to be gradually increased in the vicinity of said front address of said predetermined segment, while said mixing rate is controlled to be gradually decreased in the vicinity of said end address of said predetermined segment.

3. A musical tone signal generating apparatus according to claim 1, wherein said predetermined shifting time is set identical to a half of the time required to read out one segment.

4. A musical tone signal generating apparatus according to claim 1, wherein said first and second musical tone waveform data are read from said memory means based on a time-sharing system.

5. A musical tone signal generating apparatus comprising:

(a) a waveform memory for storing musical tone waveform data indicative of plural cycles of a musical tone waveform, said musical tone waveform being divided into several segments each designated by a front address and an end address, wherein a reading operation of said memory means is controlled by designating addresses;

(b) address designating means for sequentially designating plural series of addresses each designating the same segment with a predetermined time lag, by which plural series of musical tone waveform data are sequentially read from said waveform memory;

(c) mixing rate control means for controlling a mixing rate by which said plural series of musical tone waveform data are to be mixed together; and (d) means for mixing said plural series of musical tone waveform data by said mixing rate, whereby a musical tone signal is generated in response to mixed musical tone waveform data.

6. A musical tone signal generating apparatus according to claim 5, wherein said waveform memory includes a read-only memory (ROM) for pre-storing said musical tone waveform data and a random-access memory (RAM) capable of storing said musical tone waveform data consisting of plural sampling data concerning a musical tone waveform which is picked up from an external device.

7. A musical tone signal generating apparatus according to claim 6 wherein a storing area of said ROM is divided into several middle areas each corresponding to each of predetermined tone colors and each middle area includes several small areas each corresponding to each of tone areas of a keyboard of said electronic musical instrument, while a storing area of said RAM is divided into several areas each capable of storing said musical tone waveform data by each tone area.

8. A musical tone signal generating apparatus according to claim 6 wherein said external device is a microphone.

9. A musical tone signal generating apparatus according to claim 5, wherein said predetermined time lag is set identical to a half of the time required to read out one segment.

10. A musical tone signal generating apparatus according to claim 5, wherein said plural series of musical tone waveform data are sequentially read out based on a time-sharing system.

11. A musical tone signal generating apparatus comprising:

(a) a waveform memory for storing musical tone waveform data indicative of plural cycles of a musical tone waveform, said musical tone waveform being divided into several segments each having two edges which are respectively designated by a head address and an end address, wherein a reading operation of said waveform memory is controlled by designating said head and end addresses;

(b) address designating means cable of designating desirable two pairs of head and end addresses, based on a time sharing system, by which two series of musical tone waveform data both concerning the same segment of said musical tone waveform are sequentially read from said waveform memory, wherein a predetermined phase difference is set between said desirable two pairs of head and end addresses;

(c) mixing rate control means for controlling a mixing rate in accordance with said desirable two pairs of head and end addresses; and (d) means for mixing said two series of musical tone waveform data by said mixing rate, whereby a musical tone signal is generated in response to mixed musical tone waveform data.

12. A musical tone signal generating apparatus according to claim 11, wherein said predetermined phase difference is set identical to a half of the phase of one segment.

13. A musical tone signal generating apparatus according to claim 11, wherein said address designating means designates said desirable two pairs of head and end addresses based on a time-sharing system.

* * * * *